US008662120B2

(12) United States Patent
Riviere et al.

(10) Patent No.: US 8,662,120 B2
(45) Date of Patent: Mar. 4, 2014

(54) COMPLETE ASSEMBLING OF MASSIVE ELEMENTS

(76) Inventors: Jim Riviere, Ile de la Réunion (FR); Alain Florentin Mandoce, Ile de la Réunion (FR)

( * ) Notice: Subject to any disclaimer, the term of this patent is extended or adjusted under 35 U.S.C. 154(b) by 138 days.

(21) Appl. No.: 12/932,199

(22) Filed: Feb. 18, 2011

(65) Prior Publication Data

US 2011/0203203 A1 Aug. 25, 2011

Related U.S. Application Data

(63) Continuation-in-part of application No. 11/795,371, filed as application No. PCT/FR2006/000011 on Jan. 4, 2006, now abandoned.

(30) Foreign Application Priority Data

Jan. 20, 2005 (FR) ..... 05 00601
Aug. 20, 2008 (WO) ..... PCT/IB2008/002168

(51) Int. Cl.
*B27F 1/00* (2006.01)

(52) U.S. Cl.
USPC ..... 144/347; 52/233; 52/586.2; 52/585.1; 52/590.1

(58) Field of Classification Search
USPC ..... 52/233, 286, 586.1, 586.2, 585.1, 52/589.1, 590.1, 590.2, 590.3, 591.1; 144/347
See application file for complete search history.

(56) References Cited

U.S. PATENT DOCUMENTS

| | | | | | |
|---|---|---|---|---|---|
| 1,843,369 | A | * | 2/1932 | Olsen | 144/347 |
| 2,005,921 | A | * | 6/1935 | Reither | 52/233 |
| 2,021,341 | A | * | 11/1935 | Ward | 52/233 |
| 2,712,678 | A | * | 7/1955 | Jensen | 52/233 |
| 2,902,733 | A | * | 9/1959 | Justus | 52/284 |
| 3,189,950 | A | * | 6/1965 | Johnson | 52/233 |
| 3,381,428 | A | * | 5/1968 | Sillman | 52/233 |
| 3,440,784 | A | * | 4/1969 | Onjukka | 52/233 |
| 4,096,674 | A | * | 6/1978 | Kollar et al. | 52/233 |
| 4,344,263 | A | * | 8/1982 | Farmont | 52/233 |
| 4,353,191 | A | * | 10/1982 | Schilbe | 52/233 |
| 4,599,837 | A | * | 7/1986 | Wrightman | 52/233 |

(Continued)

FOREIGN PATENT DOCUMENTS

| | | |
|---|---|---|
| BE | 503 335 A | 6/1951 |
| BE | 503 355 A | 6/1951 |

(Continued)

OTHER PUBLICATIONS

International Search Report dated May 26, 2009 in International Application No. PCT/IB2008/002168.

*Primary Examiner* — Chi Q Nguyen
(74) *Attorney, Agent, or Firm* — Oliff & Berridge, PLC

(57) ABSTRACT

A method for assembling massive parts that are useful for building wooden chalets or houses including timbers that are built in two by two, three by three, or four by four, connected through dovetailing, and, optionally, by gluing them together, to obtain massive laminated timber blocks. These massive laminated timber blocks can be filled to form panels. This method improves a process for forming massive wood parts, where assembling the timbers in the form of dove-tails allows the production of several depths without any limitation of length, since the additions are achieved according to an arrangement in quincunx.

18 Claims, 23 Drawing Sheets

(56) References Cited

U.S. PATENT DOCUMENTS

| | | | | | |
|---|---|---|---|---|---|
| 4,903,447 | A | * | 2/1990 | McDade | 52/233 |
| 5,020,289 | A | * | 6/1991 | Wrightman | 52/233 |
| 5,775,046 | A | * | 7/1998 | Fanger et al. | 52/590.1 |
| 5,787,675 | A | * | 8/1998 | Futagi | 52/745.1 |
| 6,023,895 | A | * | 2/2000 | Anderson | 52/233 |
| 6,357,194 | B1 | * | 3/2002 | Jones, Jr. | 52/590.1 |
| 6,427,414 | B1 | * | 8/2002 | Wing | 52/590.1 |

FOREIGN PATENT DOCUMENTS

| | | | |
|---|---|---|---|
| CH | 480 518 | A | 10/1969 |
| DE | 88 09 611 | U1 | 10/1988 |
| DE | 41 23 682 | A1 | 1/1993 |
| DE | 93 06 205 | U1 | 6/1993 |
| FR | 981 417 | A | 5/1951 |
| FR | 2 880 904 | A1 | 7/2006 |
| GB | 553 937 | A | 6/1943 |
| JP | 2004 142139 | A | 5/2004 |
| JP | A-2004-142139 | | 5/2004 |
| WO | WO 99/36235 | A1 | 7/1999 |
| WO | WO 02/10531 | A1 | 2/2002 |
| WO | WO 2007/086716 | A1 | 8/2007 |

* cited by examiner

COMPLETE ASSEMBLING OF MASSIVE ELEMENTS

This application is a continuation-in-part of U.S. patent application Ser. No. 11/795,371 filed Jul. 16, 2007, abandoned and the present application is a 371 of Pct/IB2008/002168 filed Aug. 20,2008.

BACKGROUND

This invention relates to the field of construction, more precisely to the field of the building of massive or laminated wooden chalets.

More particularly, it has as a subject matter building members allowing to easily and shortly produce such buildings. It also relates to a key for assembling and fixing, which allows the easy mounting and dismounting of the assembled members.

As a matter of fact, there is a significant need for building members easy to reduce to practice and which are economical to achieve a temporary or a definitive building such as a hut, a garden shed, a bungalow, a chalet, a low wall, or storage facilities, in very short time and without specific knowledge.

The building must have the complete required rigidity, and must be too easily mounted and disassembled and/or been moved to be rebuilt in another place or in a different manner.

These building members must also be achieved in a small scale to determine a building game for children. As regards building games, it was already known by the document DE-A-1984.5160 which discloses building blocks of about parallelepiped shape, showing on the lateral sides cons stripped grooves, closed at one end in the axial way, and in which it is possible to insert a coupling member joining the blocks two by two. Nothing has been foreseen to lock the blocks one above the others, what implies a building using successive layers, these layers being susceptible to be unstable, the ones with the others.

This drawback has been cancelled in the building game as disclosed in EP-A-0 911 070, which describes cubic-shaped building blocks, an opening having been made on each side of the cube in order to introduce a connection peg between two adjacent cubes.

A technical problem then appears when the user wants to erect a wall with at least two blocks rows, since he must at first wholly achieve each row, and then, fasten the rows the ones with the others.

Apart from the domain of games, it has been known by the document EP-A1-050636 a modular system constituted by wooden boards horizontally arranged, the ones above the others, and glued together. Such a system gives a bulky and permanent aspect to the building which cannot be easily performed.

This patent application discloses a set of assembly including baulks arranged together with members of parallelepiped shape and of a triangular section which are joined together two by two on the side of the hypotenuse.

These members of triangular section have a protruding blade intended to be inserted in a vertical section of the panels. They bear several openings allowing the bolting of the metallic pole to the load-bearing wall. This pole is used at the same time as a stringer (stiffener) of the panel.

SUMMARY

In the same international patent application, it has been disclosed an additional feature which consists in the fact that the timbers or the wooden parts are joined together by sliding in the ribs, in order to make up a dovetailed assembly, ensuring the stiffening of the assembly. This invention aims to still improve a process for introducing massive wood timbers, the assembly of which in the form of dove-tails allows the production of several depths without any limitation of length, since the additions are achieved according to an arrangement in quincunx.

It has also been known from the US patent U.S. Pat. No. 5,996,302 an assembling system of a row of wooden boards which uses a mortise and tenon joint. The locking is ensured by means of plugs which cause the system to be somewhat complex and unworkable, except for a very skilled handyman, or a man having an experience in the wood manufacture.

It has also be known from EP-A-0898027, molded blocks for building, each one showing on the upper and lower sections, respectively male and female embossings intended to promote the set up of a wall. These blocks need to use cement between each block.

In the prior filed patent FR 2.824.094 (in the name of RIVIERE Camille Jim), it was disclosed an invention in this situation which aimed at obviating the afore-said drawbacks of the prior art, while reaching the aims which have been previously disclosed. This invention then related at first a set of building members including bricks, poles, frames, casings, "entraits", purlins, each brick having the shape of a right-angled parallelepiped having two opposite faces, essentially flat, making up a face of a determined height and length, which are separated from four successive sides forming the section of the brick.

A clear improvement in the building members in order to bring more rigidity and to give to them a character of generality which allows the achievement and the mounting of any kind of house and of any king of housing units and other landscape, has been disclosed in the international patent application PCT/FR2006/000011 in the name of Riviere J. and Mandoce A.

DETAILED DESCRIPTION OF EMBODIMENTS

It is thus achieved the construction of chalets by means of timbers of massive wood, having a thickness of about 7 cm and shaped with a dove-tailed assembly. That is the way, double 13 cm thick wooden timbers are formed, and/or 19 to 24 cm thick threes, and more should it appear necessary.

The glue to be used is a polyurethane-based monocomponent glue, such as the glue KLEBERIT 501. However, this glue is only cited as an example. Should it be necessary for some technical reasons, or as a result of new regulations, it may be adopted another glue, the choice of it is not a problem.

This process brings with it a clear benefit on the raw materials because one operates with manufactured massive wood of class 4, and which becomes by joining plywood or a glue lamella block.

According to a particular embodiment of the invention, in the case of a threes block, a void space is let during the mounting as shown in FIG. 12, which among other advantages, allows the insertion of electronic tubes or the going through of fluids. In this passage, it may be possible to inject an insulating material such as expansible urethane foam, or another insulating agent.

The central timber thus shows on some places a void with a length of about 50 cm, and shows at each end—high or low—a dovetailed assembly, male at the upper stage, and female at the lower stage, and laterally at least two male or female dovetailed assemblies.

In that manner, the assembly of timbers, whatever the lengths, is clearly rigid, while being optionally sliding.

The special feature of this assembly system lies in the fact that it is possible to fit together the timbers, two by two, three by three, or four by four, which are afterwards glued together by assembling, in order to get in that manner a massive glue/lamella block. However, the option without gluing can be foreseen in some cases.

The nature of the wood the timbers are composed of may be very various since the assembly allows the joining together of very various qualities of wood, such as conifers or precious woods.

Figure 10:
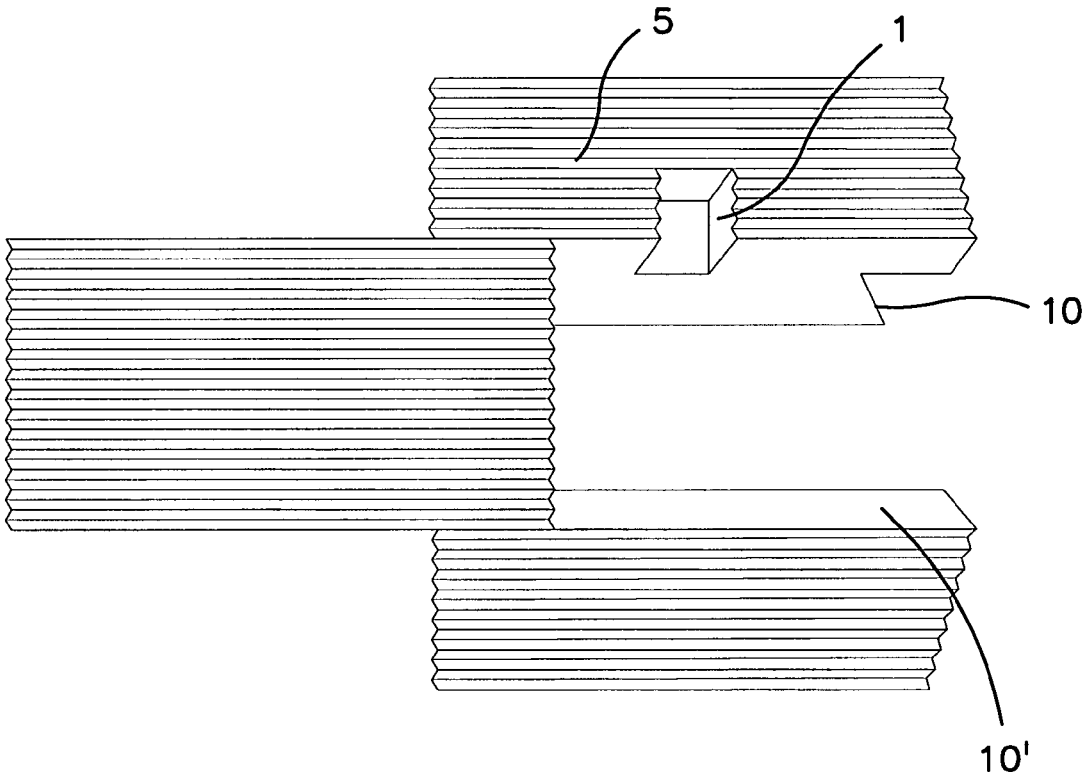
FIGS. 10 and 11 illustrate the slideing of the timbers in twos or in threes.

In the FIG. 10 in this arrangement, the internal timber shows discontinuous leaks allowing the passage of electric and fluid ducts stuffed with an insulating material of the polystyrene type in order to ensure a perfect thermic and phonic proofness.

Figure 11:
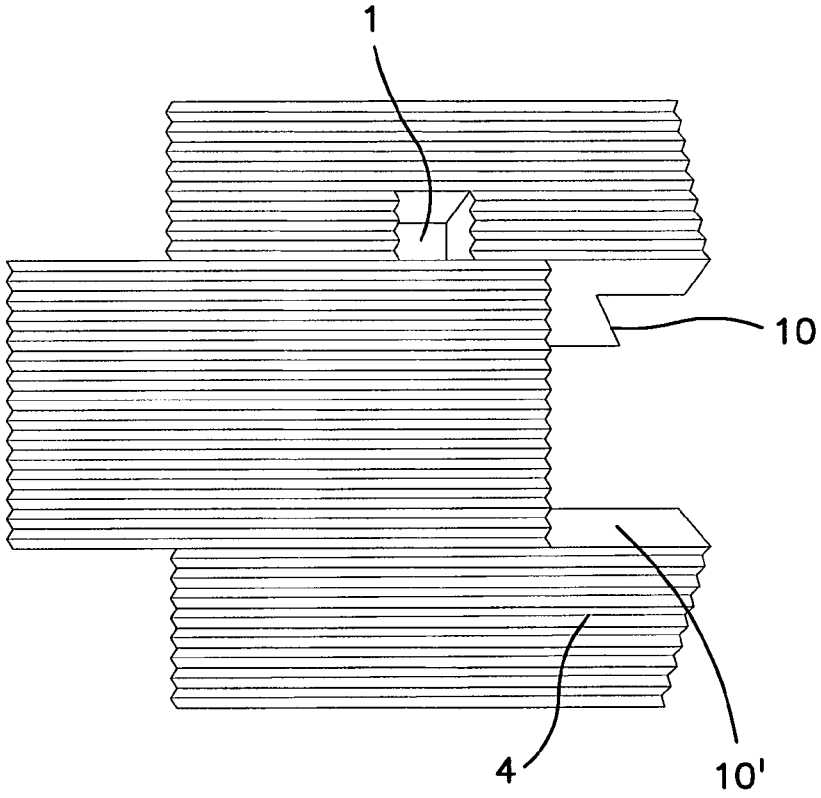

The passage may be also be achieved by boring on one of the timbers as shown on FIGS. 10 and 11 for blocks in twos or in threes.

The process according to the invention entails another advantage. The dove-tailed assembly in the depth and in quinconx arrangement in the length, allows the achievement of any kinf of measure.

These ensembles may include three timbers (in threes) or merely two timbers (in twos), such as in FIGS. 5 and 6, 10 and 11.

Figure 1:
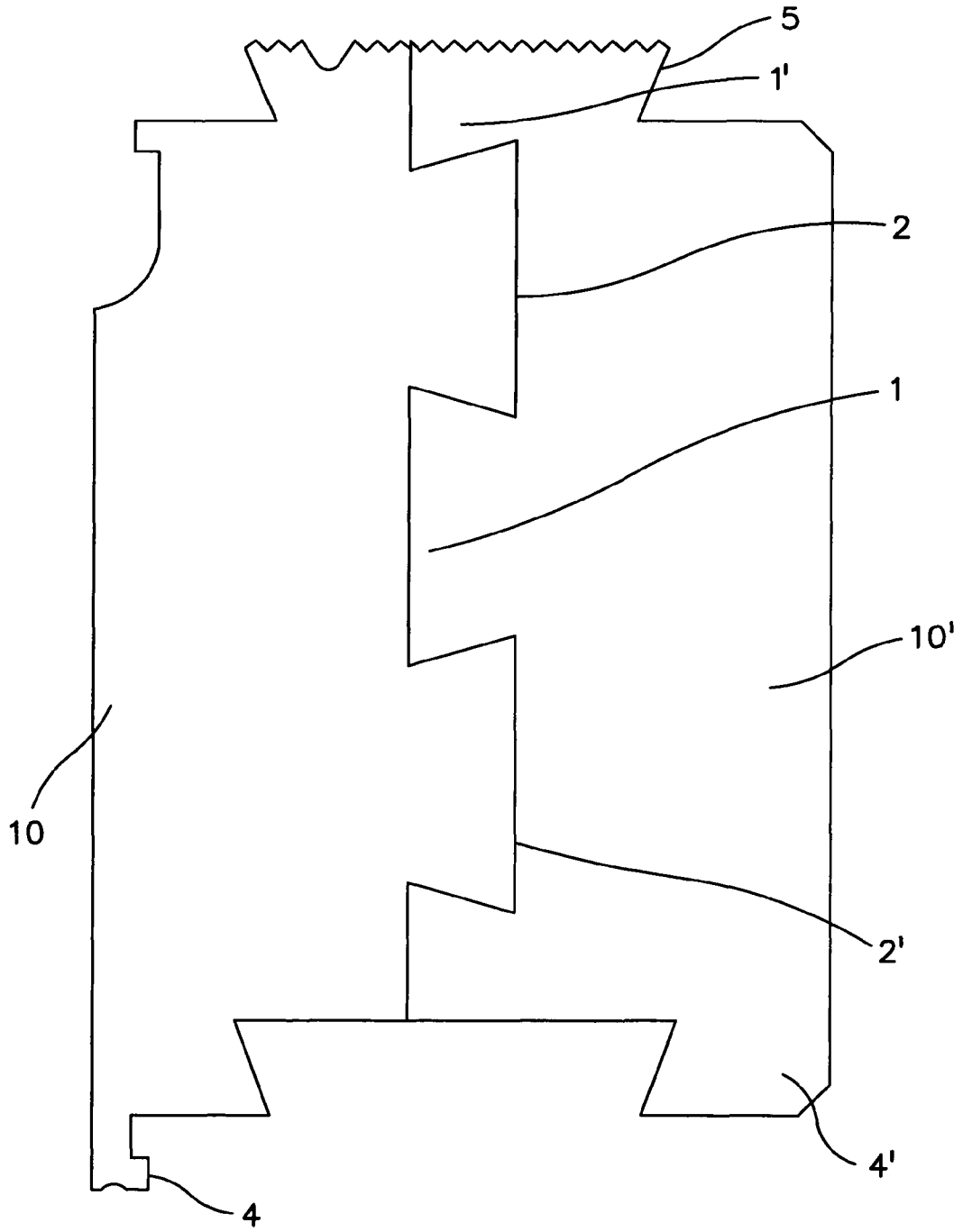
FIGS. 1 and 2 show an assembly of timbers in twos or in threes with dove-tailed assemblies.

In FIGS. 1 (in twos) and 12 (in threes), the outline of the novel profile of the building block is found. However, according to the needs, the thickness may be increased.

Figure 12:
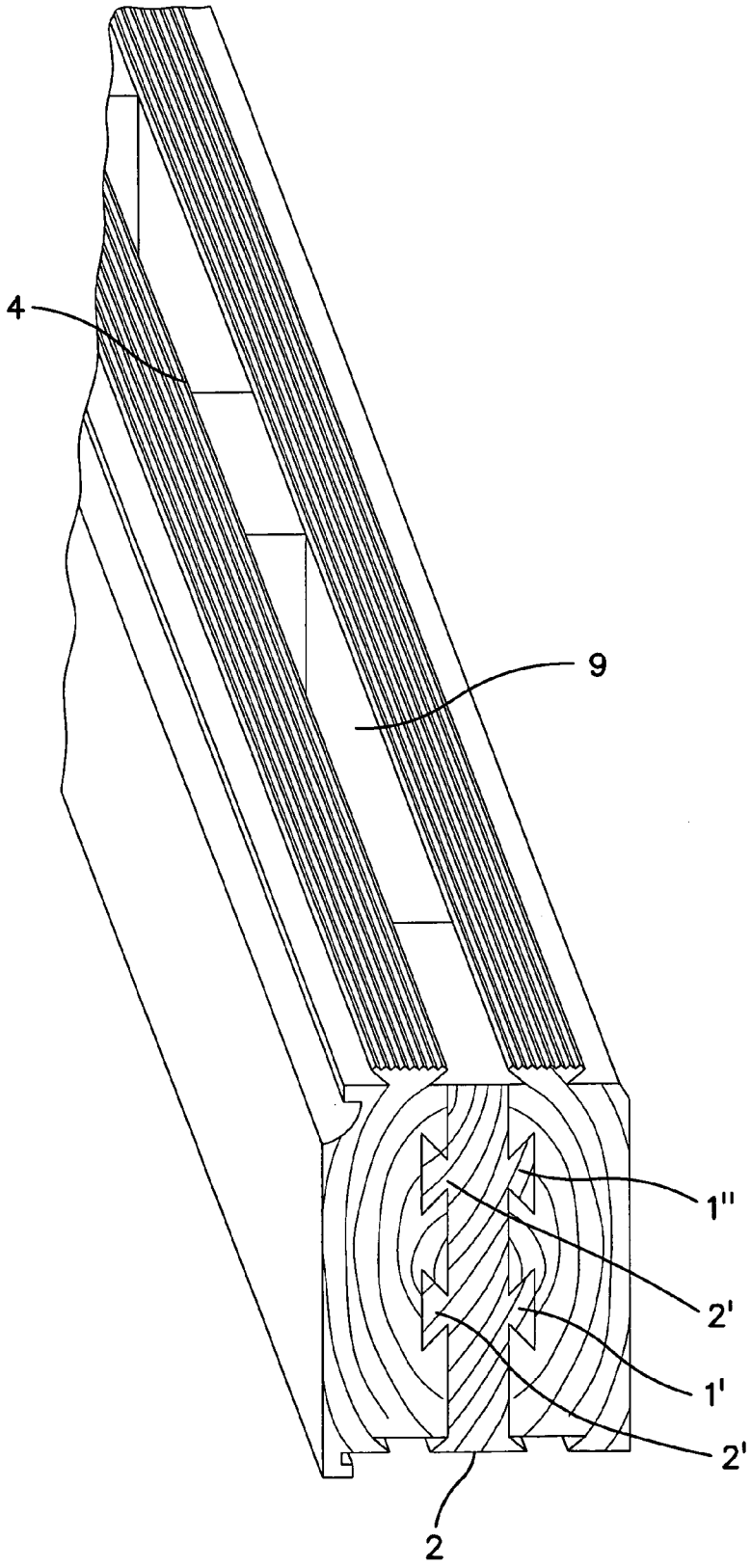
FIG. 12 shows a profile view of the building block.

The timbers may show a possibility of dove-tailed arrangement, at the upper (male)and at the lower (female) part (FIG. 12), what allows a sliding mounting.

In that manner, the manufacturing of the massive wood timbers will be performed in order to obtain several thicknesses of wood.

According to the needs, as pictured (FIGS. 1, 2, and 3), the timber includes two or three parts, because the dovetailed assembly allows an assembly of timbers in any number.

FIGS. 10 and 11 show, seen from above, the sliding of the timbers in twos or in threes. The upper part of the male dove tail is fluted, allowing an easy sliding of a block on the other, during the mounting of the panels, with integrated braces (struts).

To increase the rigidity of the mounted panel, stringers (stiffeners) must be integrated in the panel in the vertical position. Grooves are foreseen for this purpose in the vertical direction.

Figure 17:
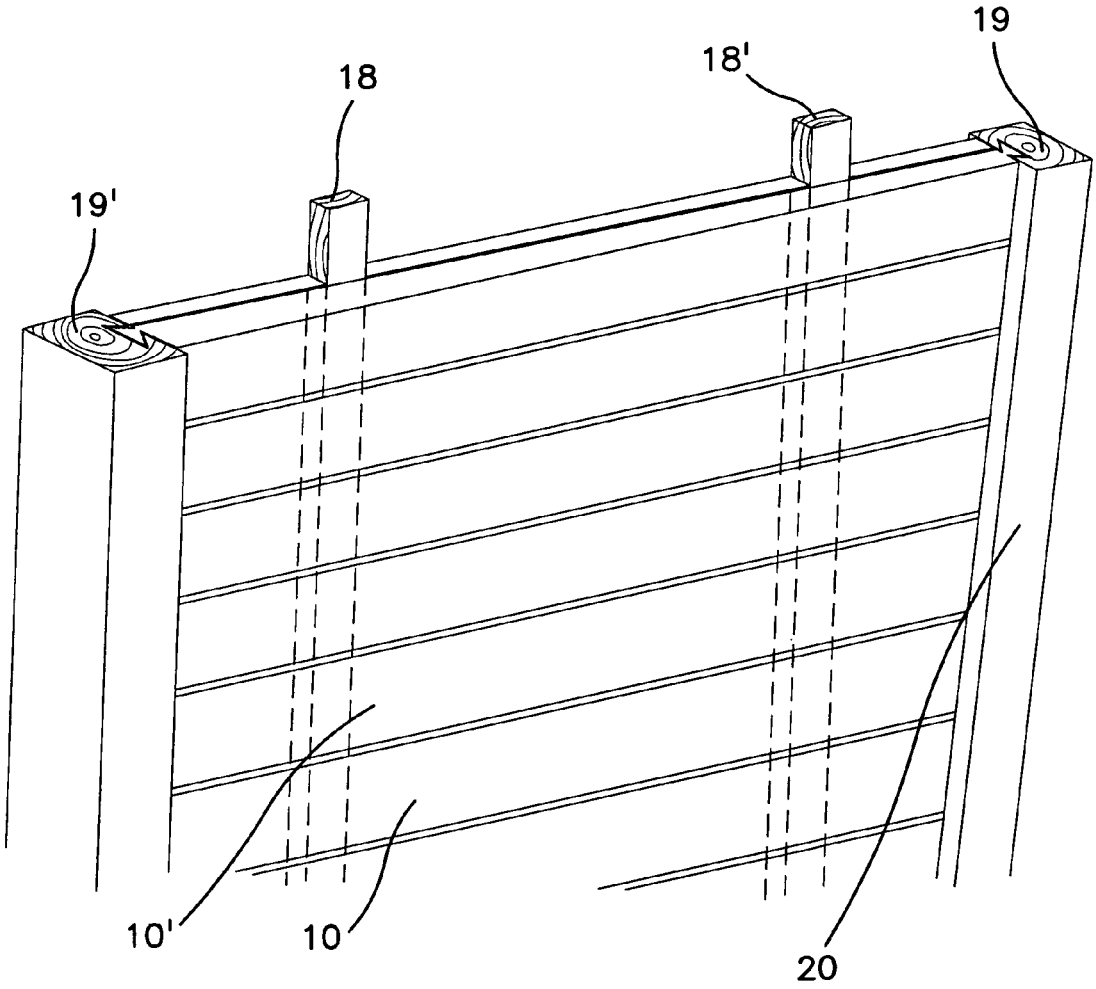
FIG. 17 shows an embodiment having grooves disposed in the middle and at both ends of the panels.

Grooves are foreseen for this purpose and are disposed in the middle and at both ends of the panels (see FIG. 17).

Figure 18:
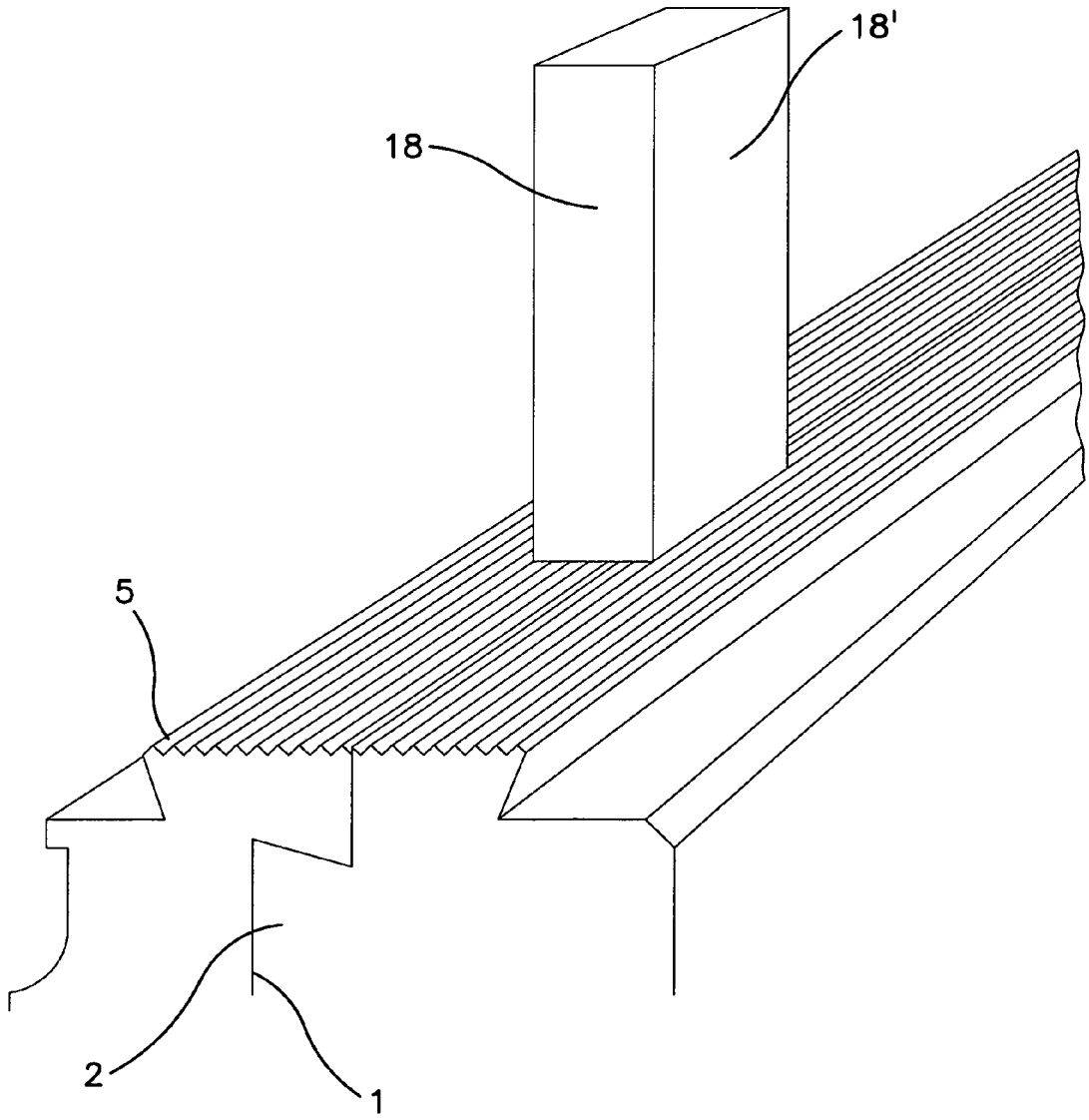
FIG. 18 illustrates an embodiment having stiffeners.
Figure 19:
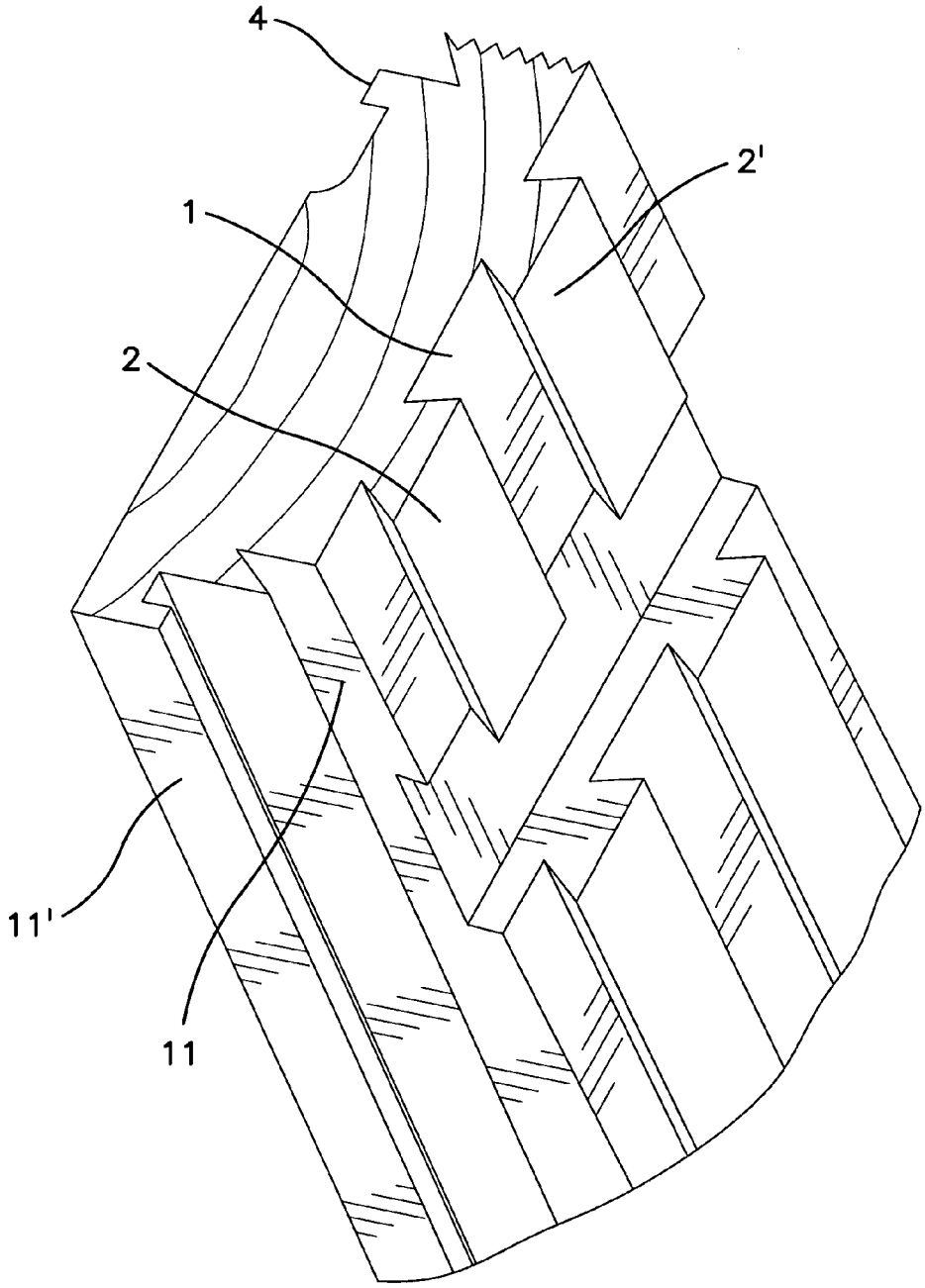
FIG. 19 illustrates a three-dimensional view of the girder block.

These stiffeners, which go through all the panel, are made out of hard wood, and have a rectangular section of 4 cm by 6 cm as shown in FIG. 18.

Figure 20:
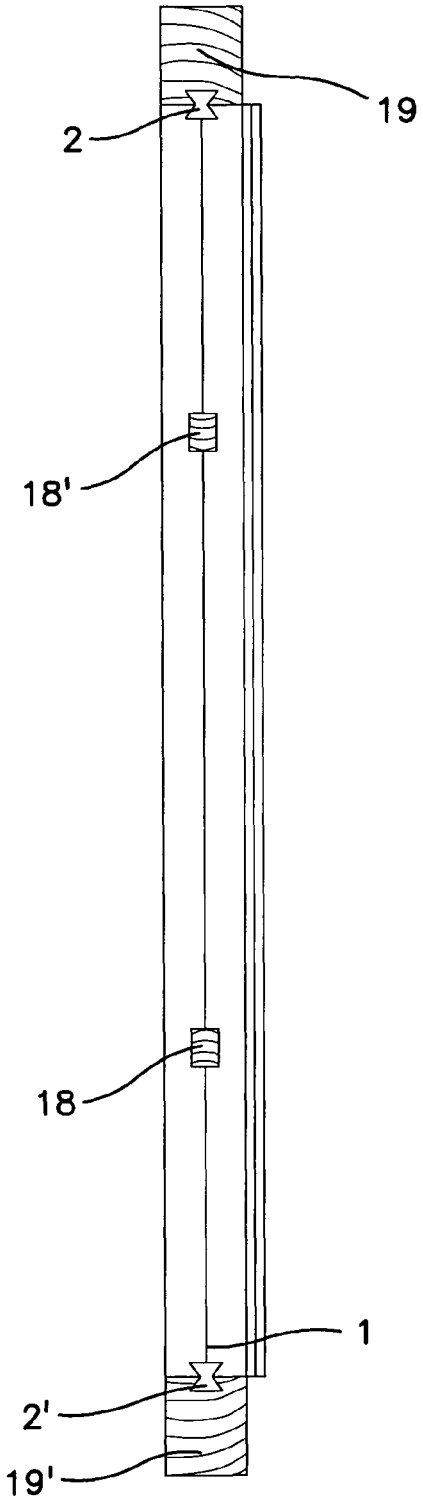
FIG. 20 illustrates a view from above where the stiffeners and the poles are disposed.
Figure 21:
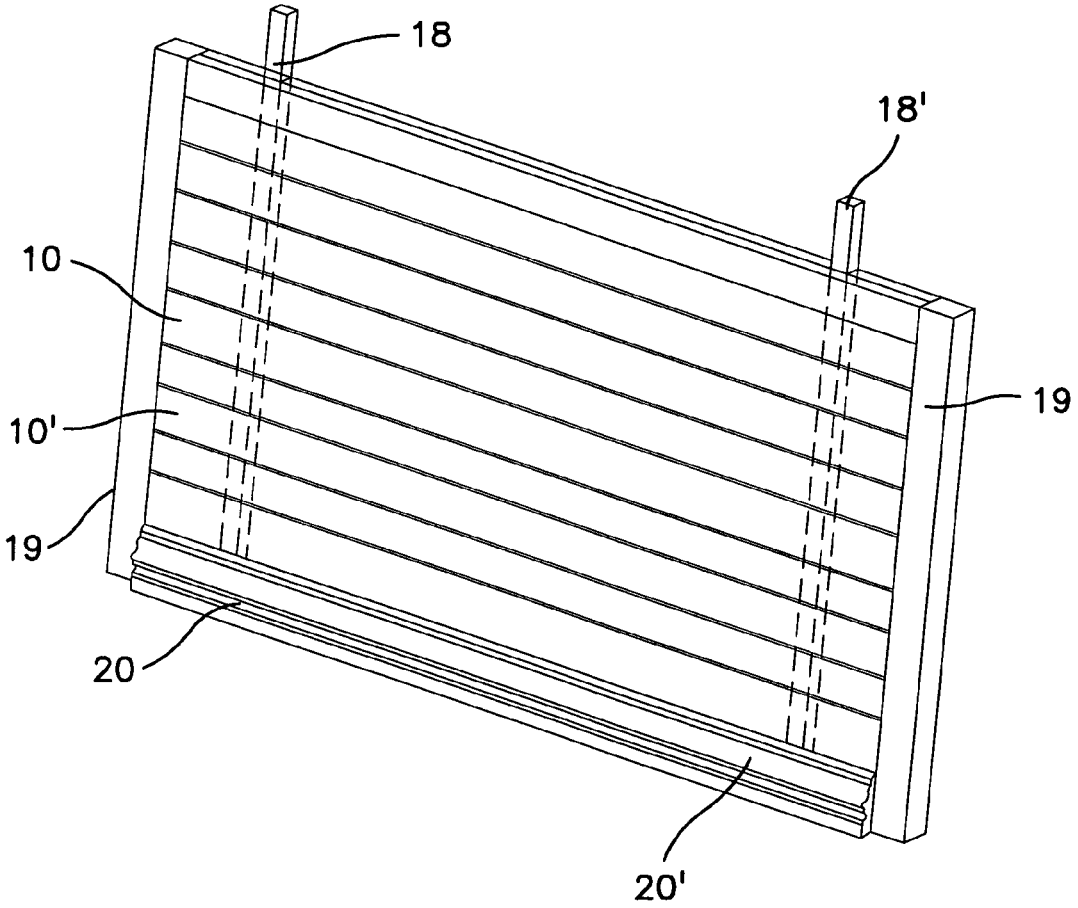
FIG. 21 illustrates a front view of where the stiffeners and the poles are disposed.

The view from above and the front view show where the stiffeners and the poles are disposed (see FIGS. 20 and 21).

Figure 22:
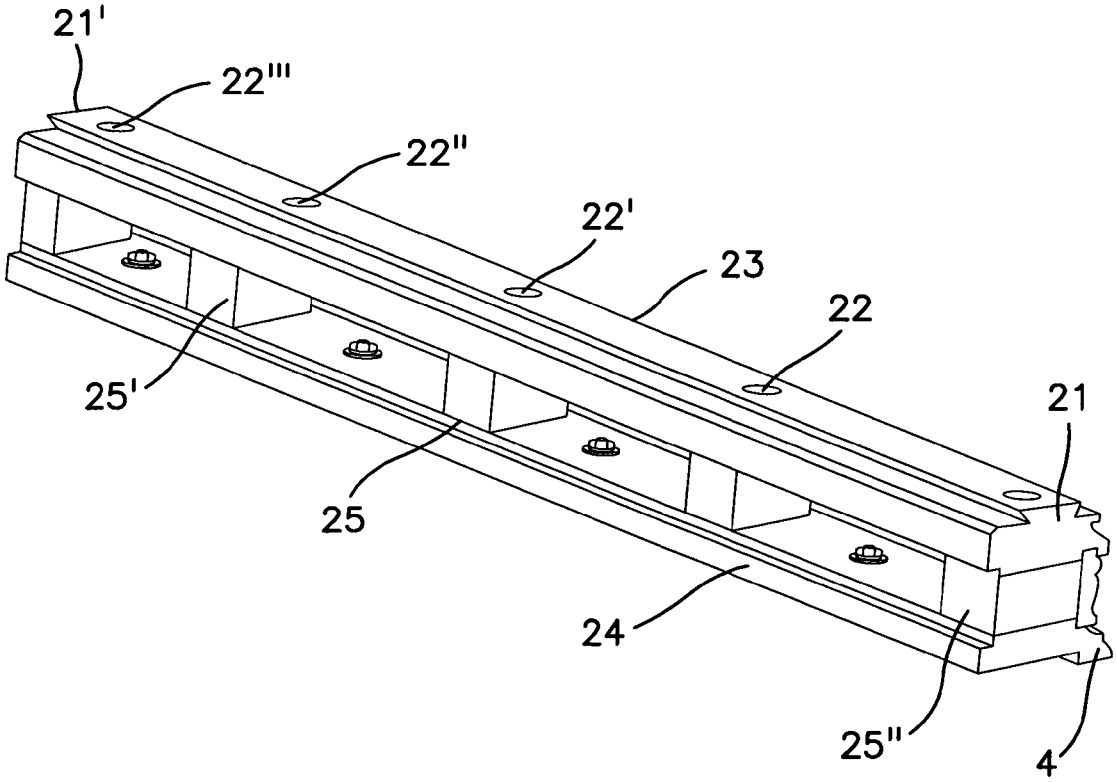
FIG. 22 illustrates an embodiment where each panel is mounted on a double stringpiece.

Each panel is mounted on a double stringpiece (see FIG. 22). This double stringpiece aims at joining the panels to the basement by bolting.

Figure 23:
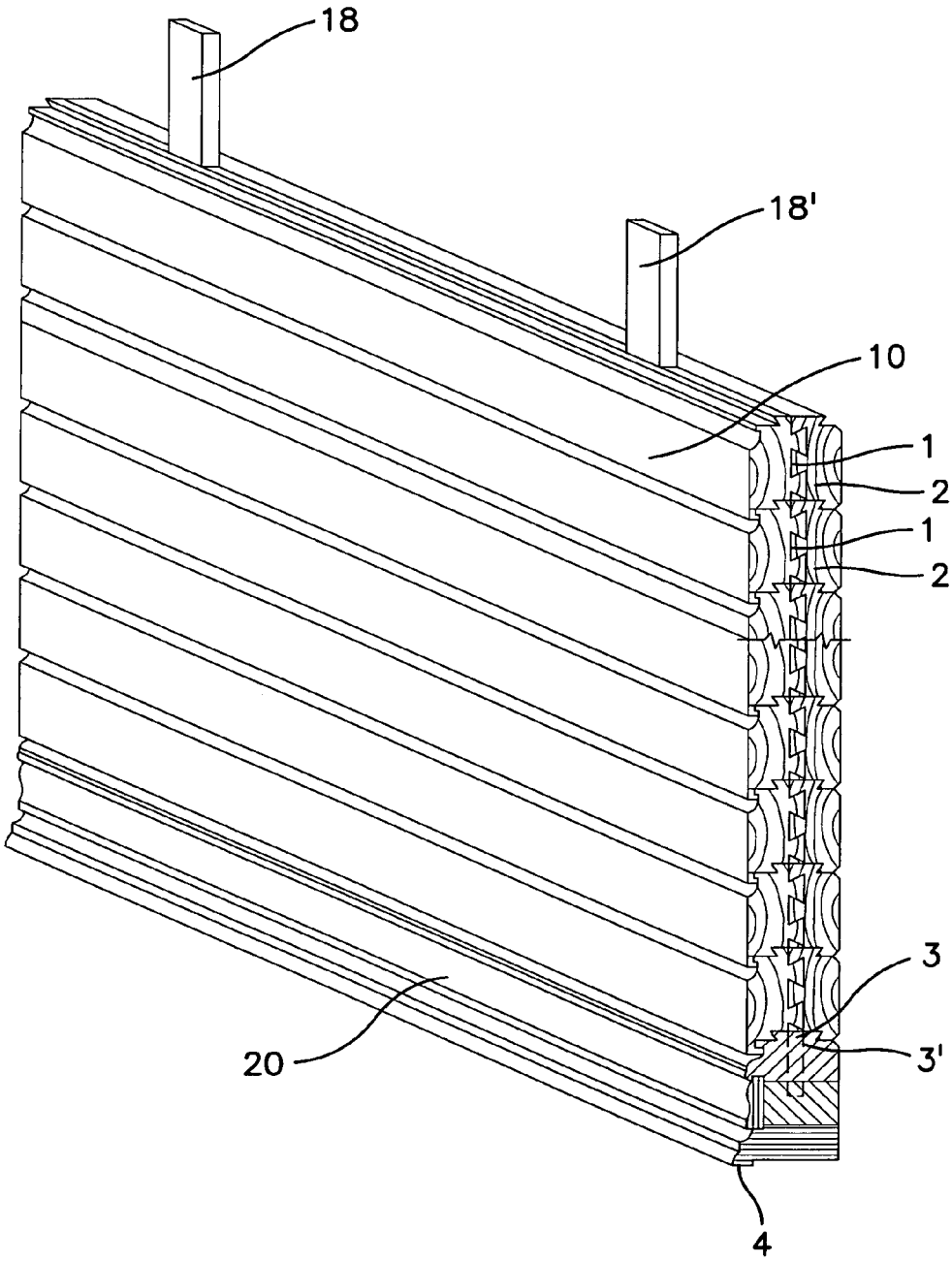
FIG. 23 shows a view from outside of the set panel with strut on a double stringpiece.

A view from outside of the set panel with strut on a double stringpiece gives an overview (see FIG. 23).

The wooden blocks which are made in that manner are aimed at the building of rigid panels, which are proper for the building of wooden chalets, according to the technique described in the French patent application 05-00601 and in the Canadian patent application 2.443.804 in the name of the applicant.

The wooden chalets find a particularly useful use in every tropical countries where frequent wheatheries, tornadoes or typhoons are likely to harm the housings and the production locations which already exist. The building thus realized show a rigidity, a solidity, and an habitability far higher than those obtained with a traditional building fitted with a wooden structure. Thanks to their configuration, these blocks are anti-seismic.

According to another feature of this invention, this invention is also suitable for the building of straight timbers.

The conception of them is the same as the one disclosed in this application, i.e., by sliding and simultaneous gluing of several small timbers, sliding on dove-tails.

Figure 13:
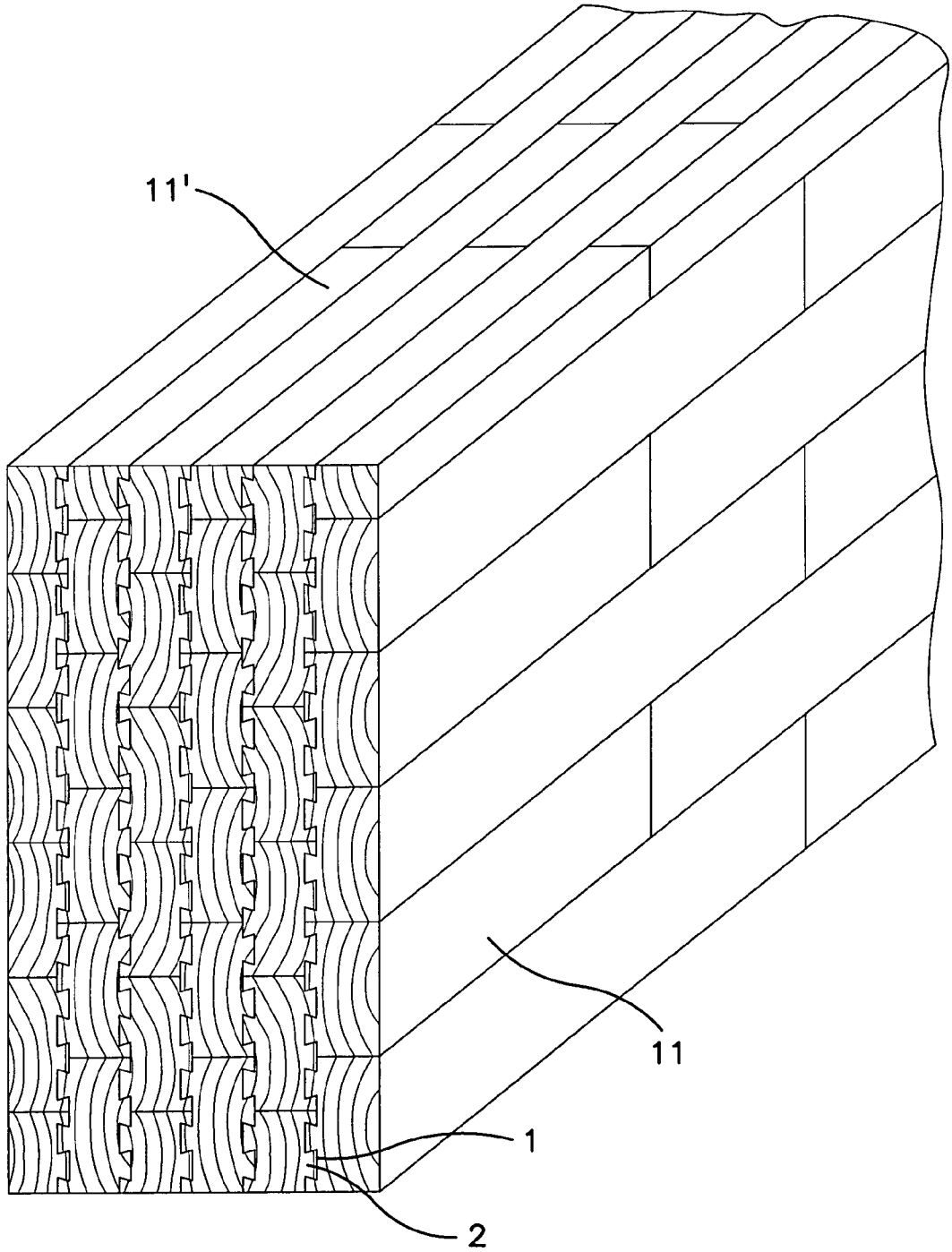
FIG. 13 shows a view of the mounted timbers.

It may thus be observed (see FIG. 13), that the thus mounted timbers look like traditional lamella-glue timber, because the dove-tails aim at hooking and at being glued with the small timber which is opposite to it within the internal part of the timber.

One among the several advantages compared with the traditional system of lamella-glue, lies in the absence of pressing since the gluing is performed simultaneously with the fitting of the timbers.

Another advantage of the process according to the invention may also be mentioned: the thickness and the length of the timbers may vary according to the needs.

This invention encompasses another advantage in comparison with the traditional system. The manufacturing of the timber may be achieved on the site where the future buildings are erected, thus avoiding the moving of the timbers through wide loads because the parts are mounted as a quincunx in an infinite number.

Would it be for the block or for the timber, this design may also be performed in several materials, by manufacturing and moulding, the materials used for the manufacturing may be of course of wood, also of plastics, concrete, plywood, aluminum, of glass and of any other rigid material. The listing of the suitable materials is not exhaustive.

Figure 14:
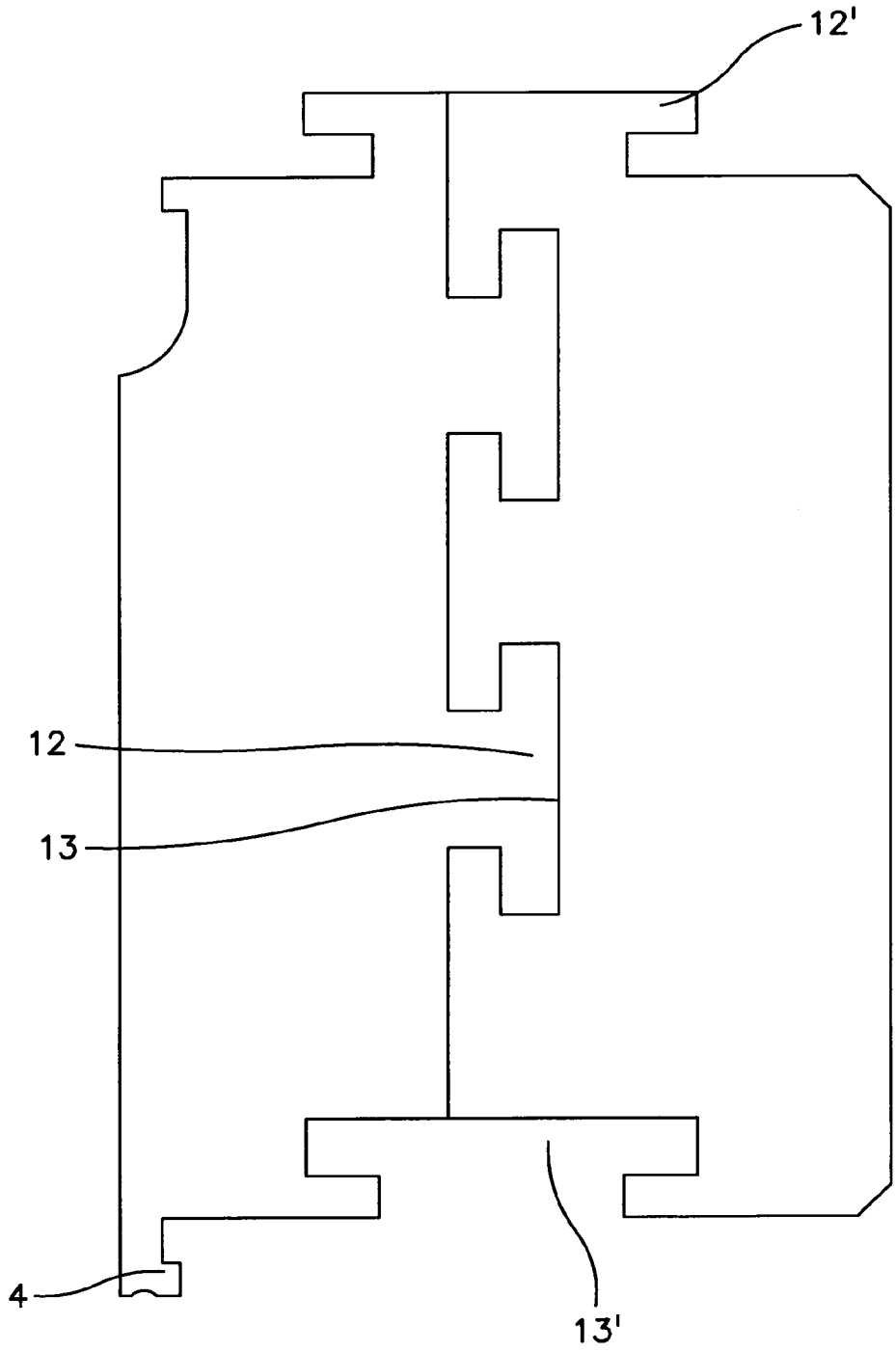
FIGS. 14, 15, and 16 illustrate other embodiments for coupling.
Figure 15:
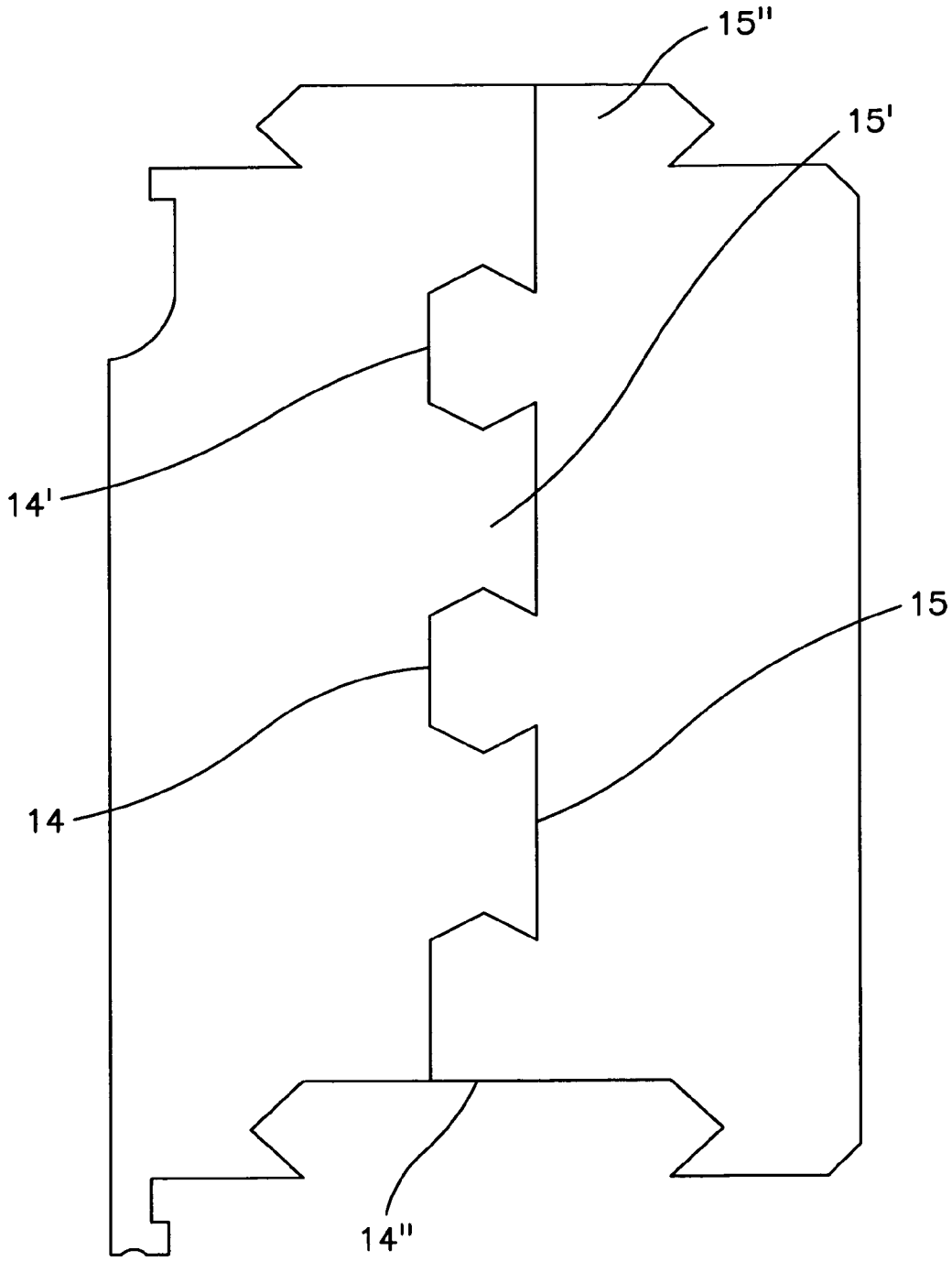
Figure 16:
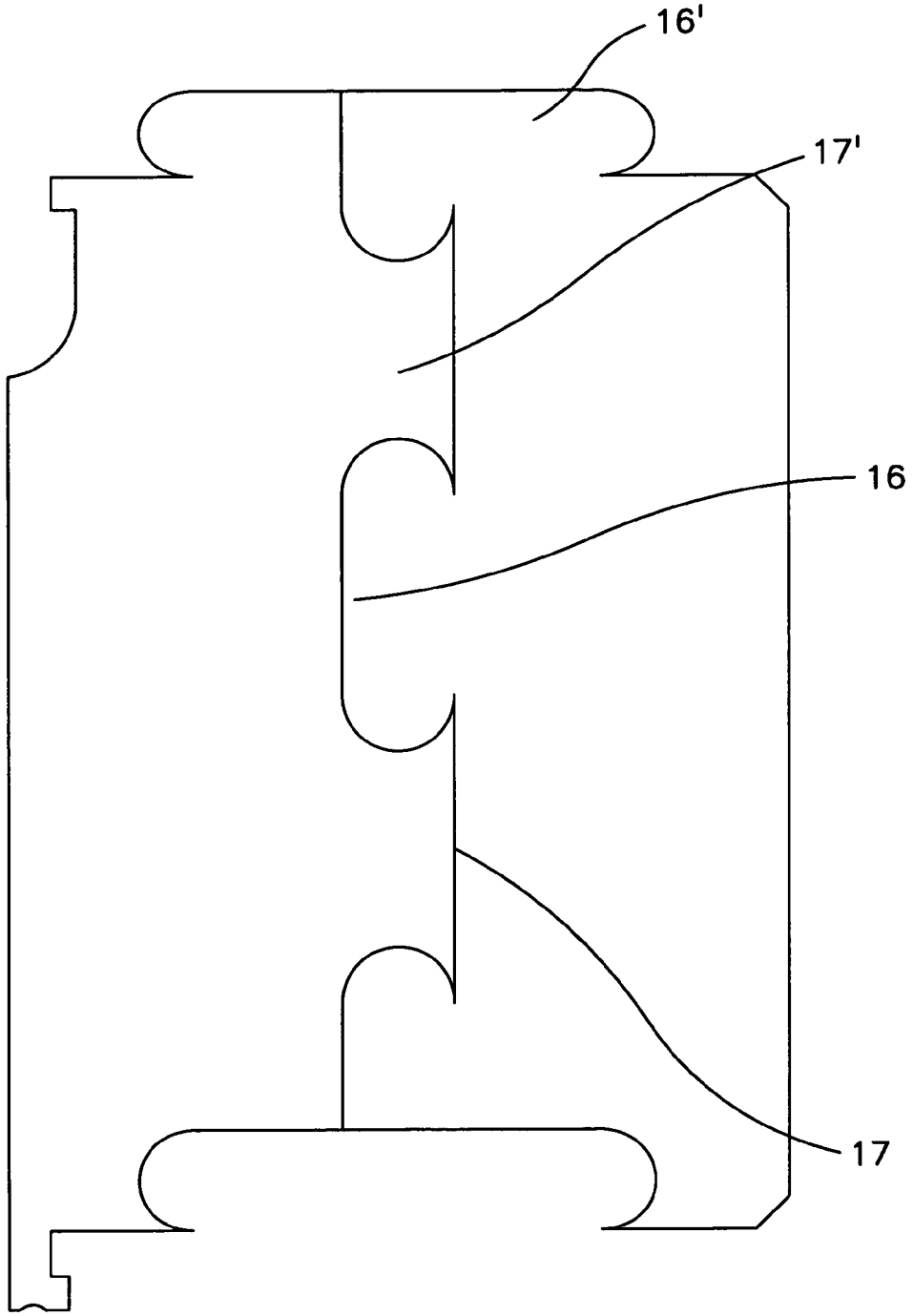

In these designs, the dove-tailed hooking may be replaced by any other system which allows an efficient hooking such as shown in FIGS. 14, 15, and 16.

Of course, every option—being the matter of hooking—poles, stringpiece, as well as all the possibilities disclosed in the patent application No 01/05787 published under the No 2.824.092, the French application 05/00601, the Canadian patent 2.443.804, the international patent application PCT/FR02/01476, or the PCT patent application WO 2006/077300, as well as all the devices disclosed in the US patent application and in the applications in the other countries where the same patent has been filed at the name of the same applicant, may be adapted to this design.

The embodiment relative to the production of building games is also possible and is also a part of the scope of this invention.

According to the invention, the mounting process consists in the use of a basic element made out of a wooden block, containing a series of female notches of trapezoidal shape, arranged all along this part, in which one or several male parts come to be interlocked, having trapezoidal metric protuberances located on a part, or on the whole length of the wooden element, and which come to insert through interlocking in the notches while forming, in this manner, dove-tailed joinings.

The wooden part may also bear on the other longitudinal side, symmetrically, male protuberances of trapezoidal shape which, to their turn, come to insert in a girder showing trapezoidal notches, so that the basic girder may be assembled on its whole length with one or two extra members capable of sliding all along the basic girder.

This girder is used as the basic element for the construction of partitions of a wall or a dividing panel. The panels are maintained in their position when using braces or poles pushed in the ground and made out of hard wood.

Such a panel may also be used as partitions for building, for domestic premises. They are fitted at each end with triangular-shaped joining members, joined together through a protruding blade which penetrates in a groove or in a split, arranged at the end of the girders.

The interest of such a mounting lies in the fact that, in the international patent application PCT/FR 2006/000011, it has been written that it was necessary to place by interposition additional members of triangular shape to increase the length of the girders.

According to the present invention, the length is freely fitted to the needs and it is not necessary to foresee any extension means.

Moreover, this process the achievement of a double string piece, which allows the assembling of the panels which are produced in this manner, and ensures in this manner thanks to a joining means the stability and the stiffness of this set. The panels are thereafter covered with a simple or double truss, ensuring the water-proofness of the building.

The presence of a stringpiece allows the avoidance of an angle post and makes the process of the building mounting simpler.

According to a specific embodiment, it is possible to contemplate a way for coupling other than by dovetailing. It is used for this purpose a system of coupling other than by a trapezoidal insertion. A coupling in the form of fret such as pictured in FIG. 14 or in the form of a polygon symmetrically arranged as shown in FIG. 15, or in the case of joining two girders with a coupling system of rounded extended shape such as a bean as pictured in FIG. 16, also provides good results. It may thus be used any coupling system the shape of which allows a grip suitable for maintaining the two girders joined and interlocked on the whole length.

The thus achieved building members may also include openings such as windows, doors, fan-lights, allowing the premises to be enough light, aerated or insulated as regards the weather, the wind, the cold, or the sun.

The thus achieved premises houses are built on the ground either through an insulating concrete slab, or, quite better, through breeze blocks or wedges, on which the turnstiles lie and set through pegs or coach bolts.

The roofing will be achieved by any kind of roofing material, according to the weather and the kind of location—straws, thatch, round or flat tiles, slate, fibrocement, or tarry clothes, are suitable for any need of water-proofing.

This invention also includes a process for mounting and/or dismounting panels of housing premises which are defined in that, two or three girders are joined lengthways, and the desired length of a panel is thus determined, the so joined panels are arranged together by using a triangular means for making elements interdependent, the thus joined panels are arranged together to the double stringpiece, while inserting the lower slot of this latter into the available dove-tail joining of the girder by sliding, in what the angle members are assembled in the facing by insertion of a joining surface into the internal hollowing of the facing, and, thereafter, another double or triple girder is transversally arranged to achieve a crossing, and, in this way, make up the sides of housing premises or storage units.

Thereafter, at each end of the wall, joining poles are arranged.

This invention will be more precisely defined in the light of the herein after annexed drawings.

FIG. 1 shows in a vertical section the assembly of two girders through dove-tails symmetrically arranged in the wooden part.

The thus assembled girder lie on the ground , using a foot on one side and through a planar surface on the other side. Moreover, the lower part of the girders shows the shape of a female part of the dove-tail joining, allowing in this manner to have, if needed, a new girder perpendicularly arranged.

Figure 2:
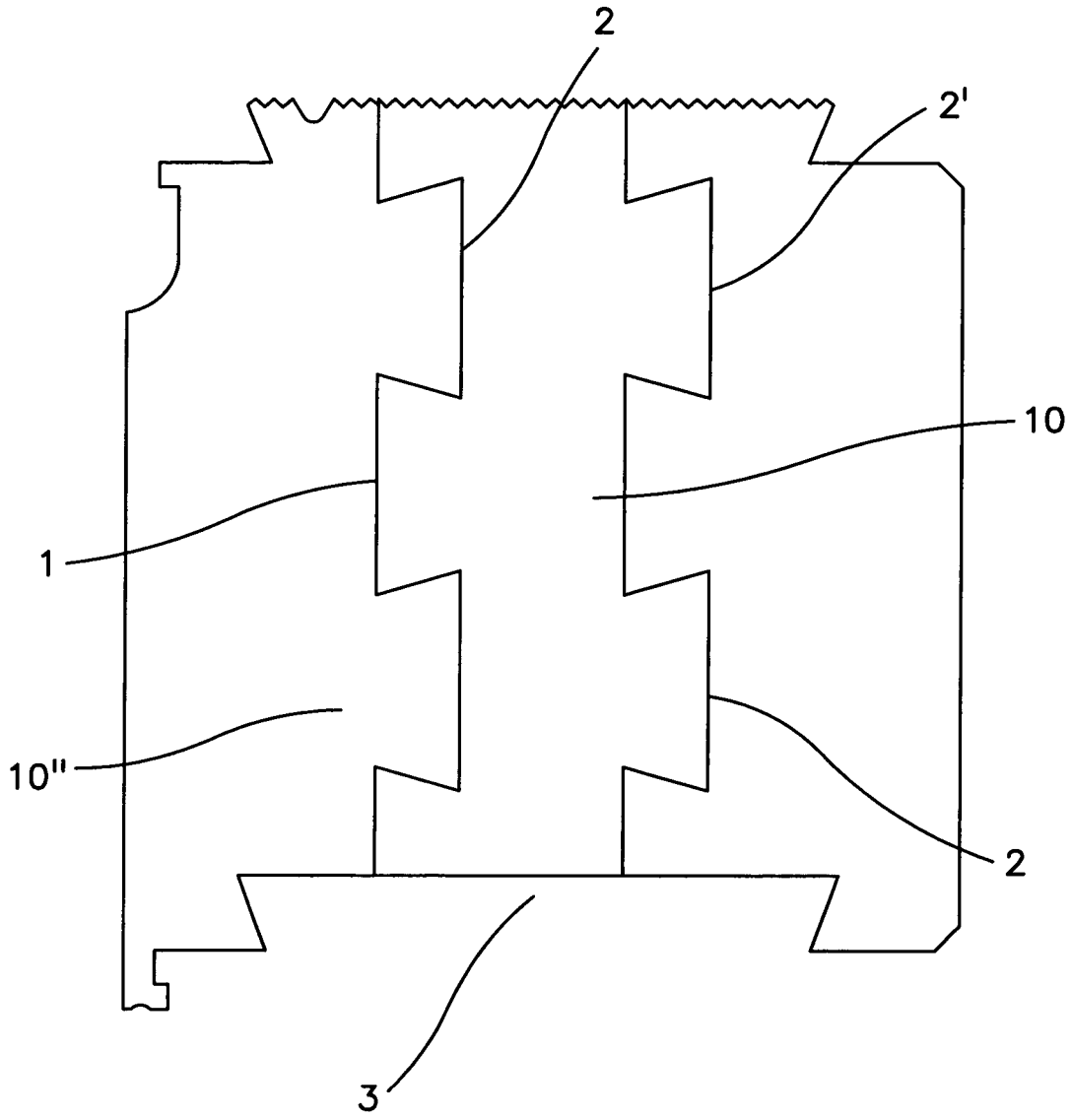

FIG. 2 shows a dove-tailed assembly of the same kind, allowing to join together three girders in width panels, much more extended are obtained, knowing that each girder or timber shows a section ranging from 40 to 55 mm, and preferably, from 45 to 52 mm. The various notches range from 15 to 20 mm deep, preferably 18 mm. The notches range from 35 to 45 mm high, preferably 40 mm for the small base and 50 mm high for the large base.

The height of this ensemble is of value. A joining block, about 200 mm high, is obtained in this manner. Its length is made adapted to the needs of the building.

Figure 3:
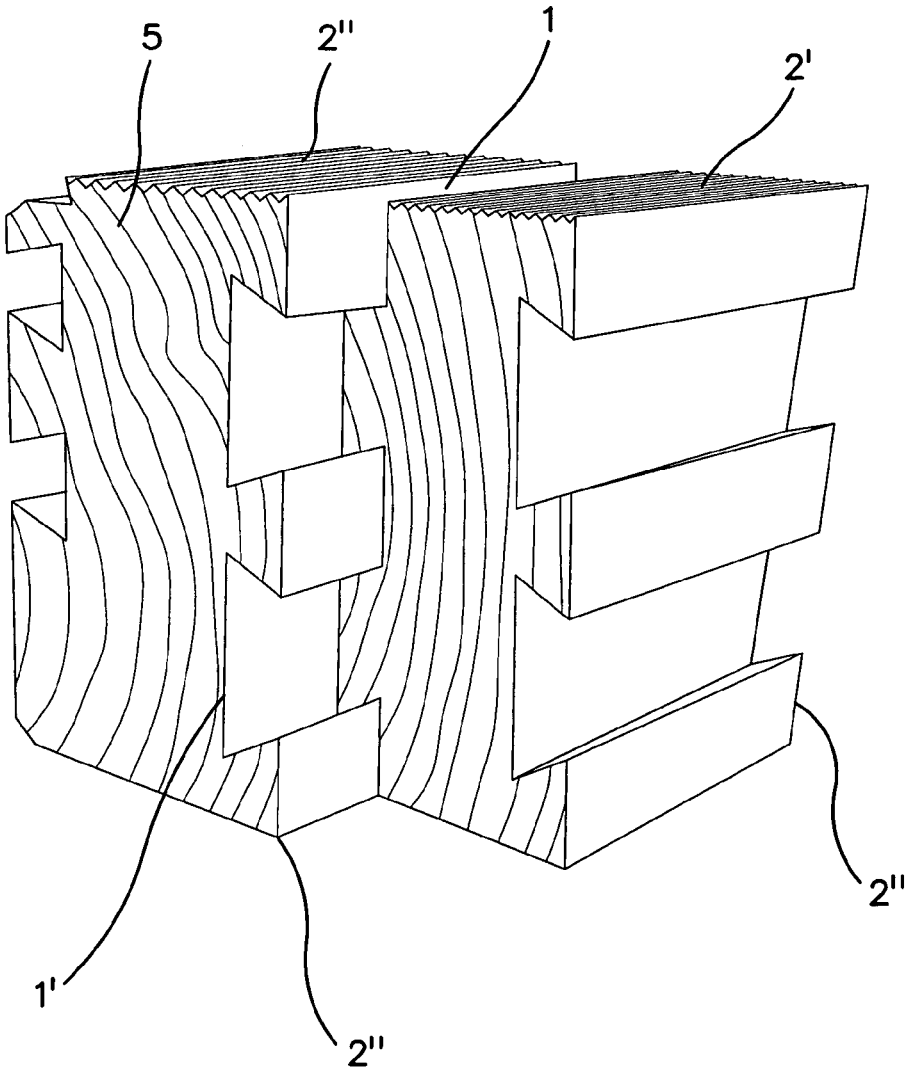
FIG. 3 shows an assembly of a three girders block.

FIG. 3 shows a reduced member of the mounting block with 3 girders, a middle block showing a cutting in male and female dovetailing interacting with a symmetric female and male coupling system.

The wooden blocks are bare or varnished or painted in order to better highlight the grain of the wood, and at the same time, more efficiently protect them from the bad weather, and insulate them.

FIG. 1 more precisely pictures the way two girders are assembled to form a base block. Here it is seen a first girder (10) inserted through trapezoidal protuberances (2) (2') in the symmetrical holes (1) (1') to form a block lying on a base (4) and by a planar face (4')

The upper part of the block shows flutes (5). The trapezoidal notch (3) interacts if needed with the stringpiece (23) through the male piece (21).

FIG. 2 shows a triple block made of a central girder (10) on which are assembled through dovetailed joinings, two girders (10') (10"). The thus achieved block is 160 to 170 mm wide. The dove-tailed device allows the sliding of the girders, the ones regarding the other ones.

FIG. 3 shows the assembly of a three girders block, the outside blocks showing a plane area. These girders are joined together in a vertical plane by using two dove-tailed junctions (1-2) and (1'-2').

The edges of the notch are numbered (2").

Figure 4:
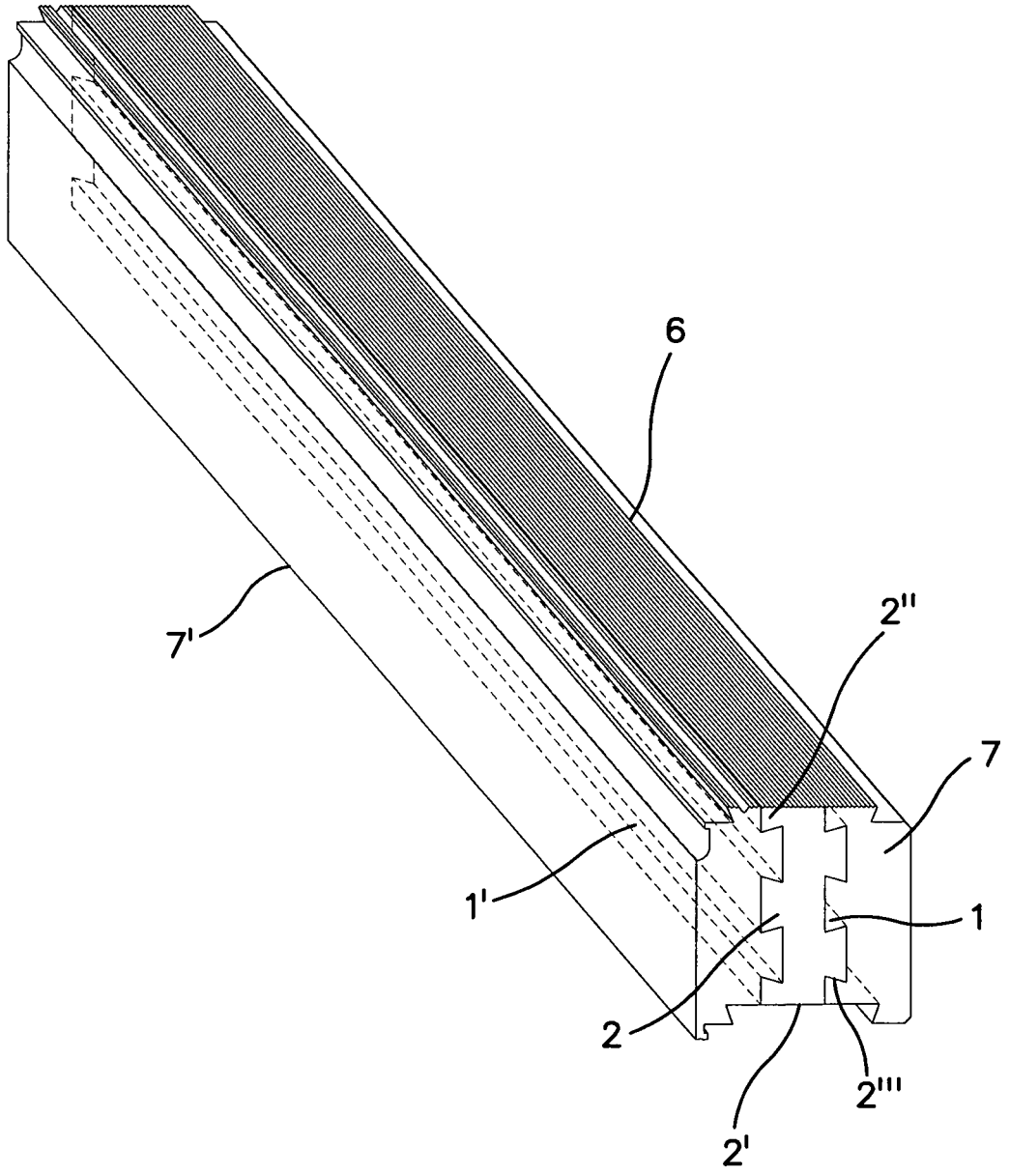
FIG. 4 pictures, in a schematic view in length, an assembly with three timbers. This longitudinal dove-tailed assembly allows the production of extended members using small parts.

FIG. 4 shows in the length a dove-tailed assembling allowing the creation of big members with parts of small section. The rims of the assembling show slots (6), which allows the way of electric wires. This assembling is achieved through an assembling block bearing slots (1) (1') on which trapezoidal protuberances come to fit (2) (2') (2") (2"). (7) and (7') show the outside facings.

Figure 5:
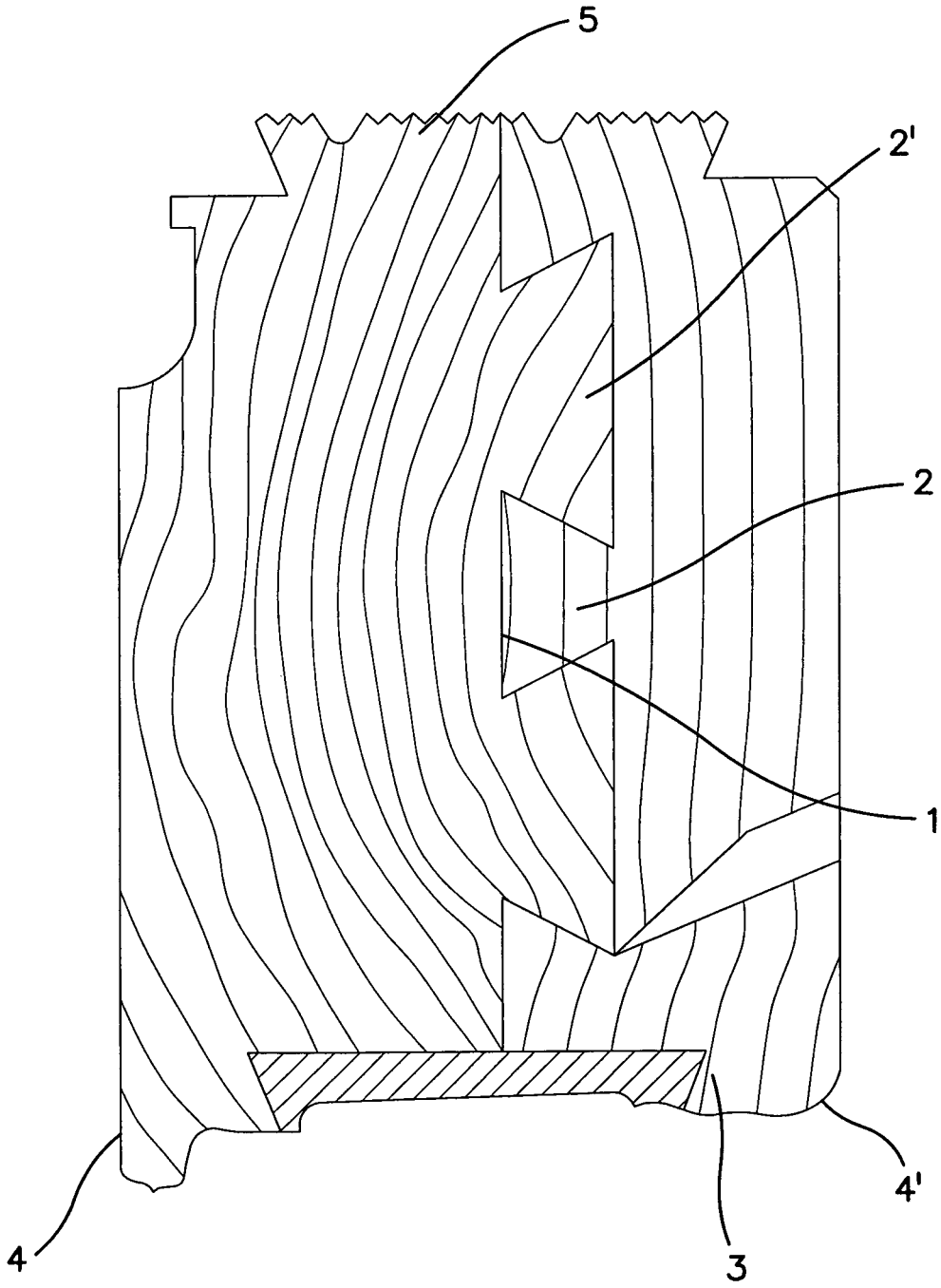
FIG. 5 shows some details of the timbers dove-tailed assembly and shows the possibility of horizontally sliding of the timbers arranged thanks to the dovetailing, as for the block in twos.

FIG. 5 shows the assembly block lying on a rigid base through the planar side (4') and the foot (4). In this block with two girders, a male girder and a female girder have been joined, sliding the one in another one.

Figure 6:
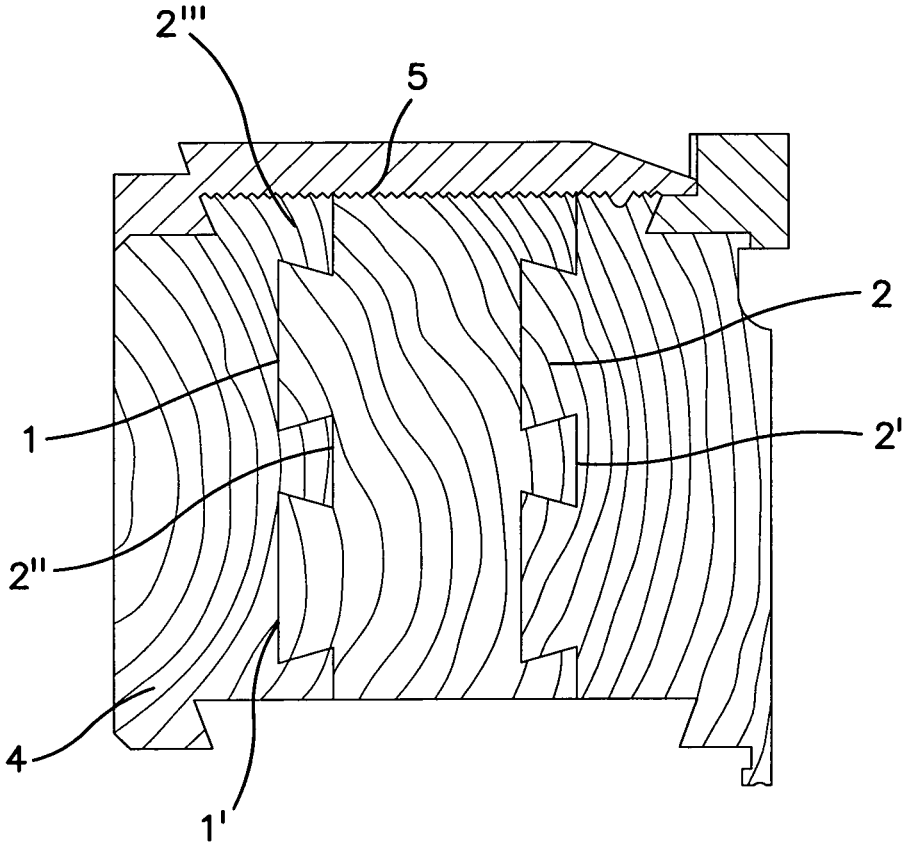
FIGS. 6, 7, and 9 show the sliding of the timbers through three dove-tailed assemblies, arranged on the lateral sides of the assembly block, as for the block in threes.

FIG. 6 shows the same arrangement including the assembling of three girders through male protuberances (2) (2') (2") and (2'") which are inserting in notches (1) and (1') to form a block of large section.

Figure 7:
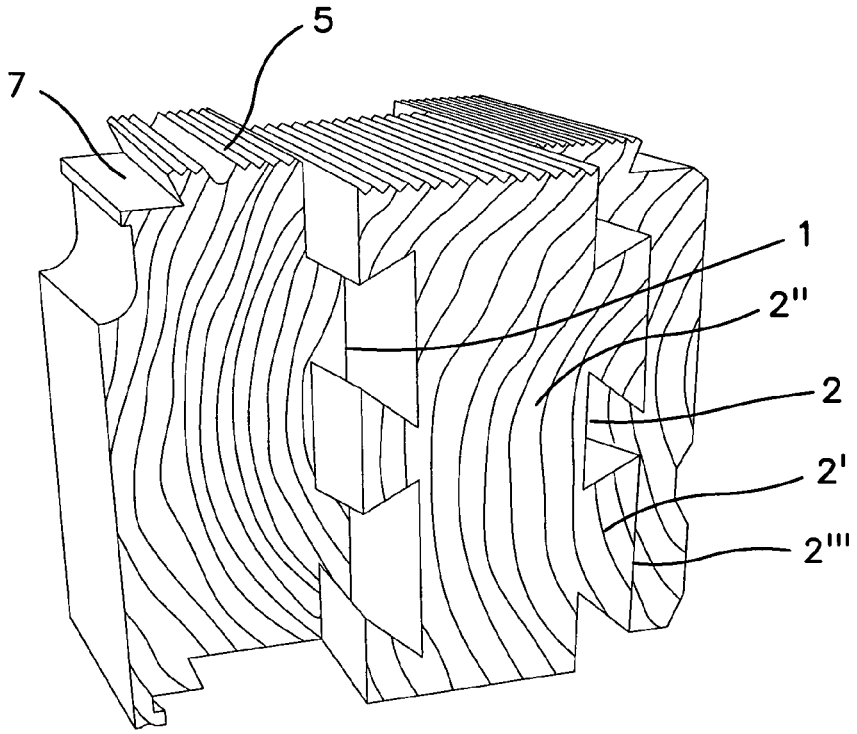

FIG. 7 shows the same assembling block with outside girders having partially slid, clearing in this manner the notches (1) and the trapezoidal protuberances (2).

Figure 8:
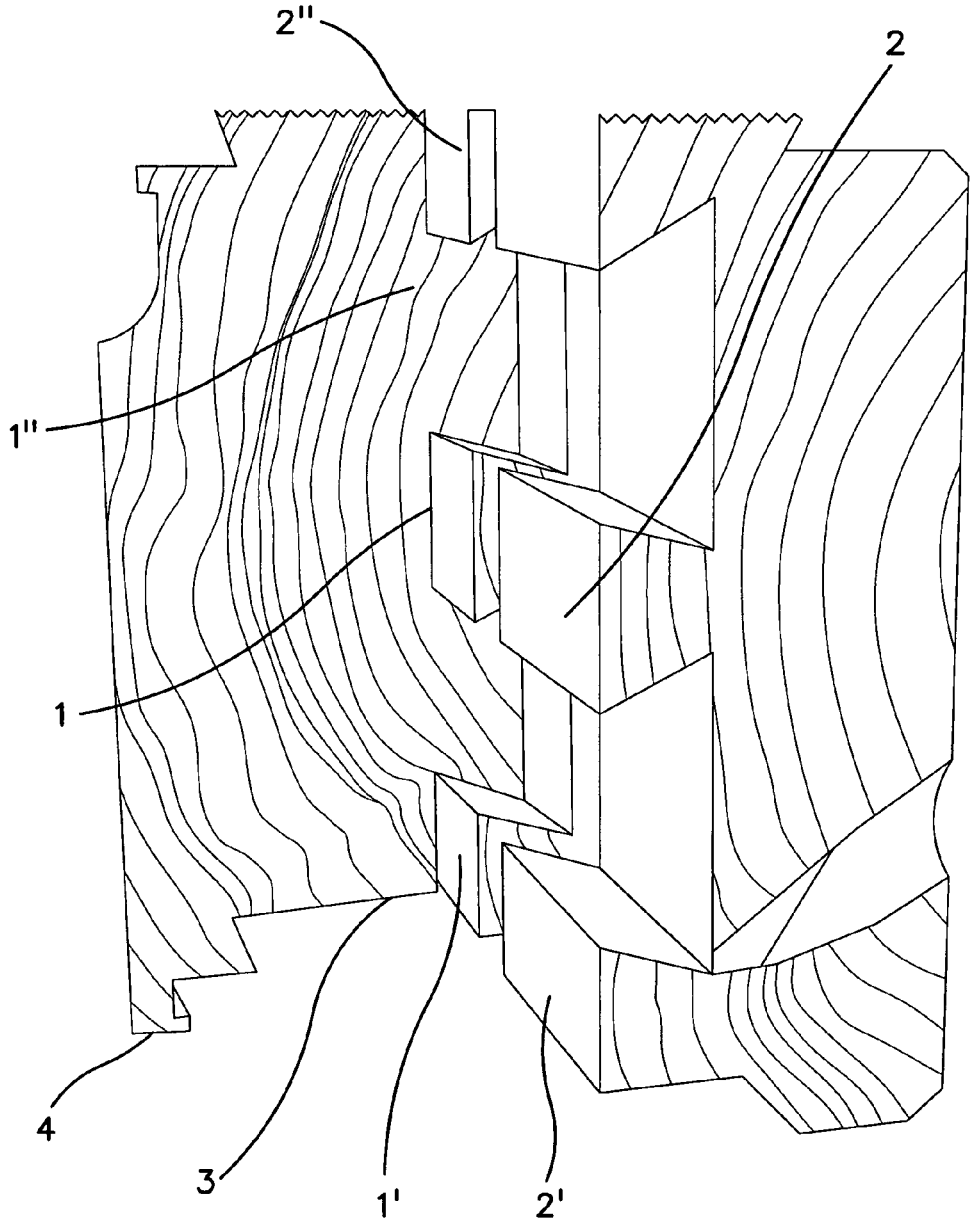
FIG. 8 shows the possibility of horizontally sliding of the timbers arranged thanks to the dovetailing, as for the block in twos.
Figure 9:
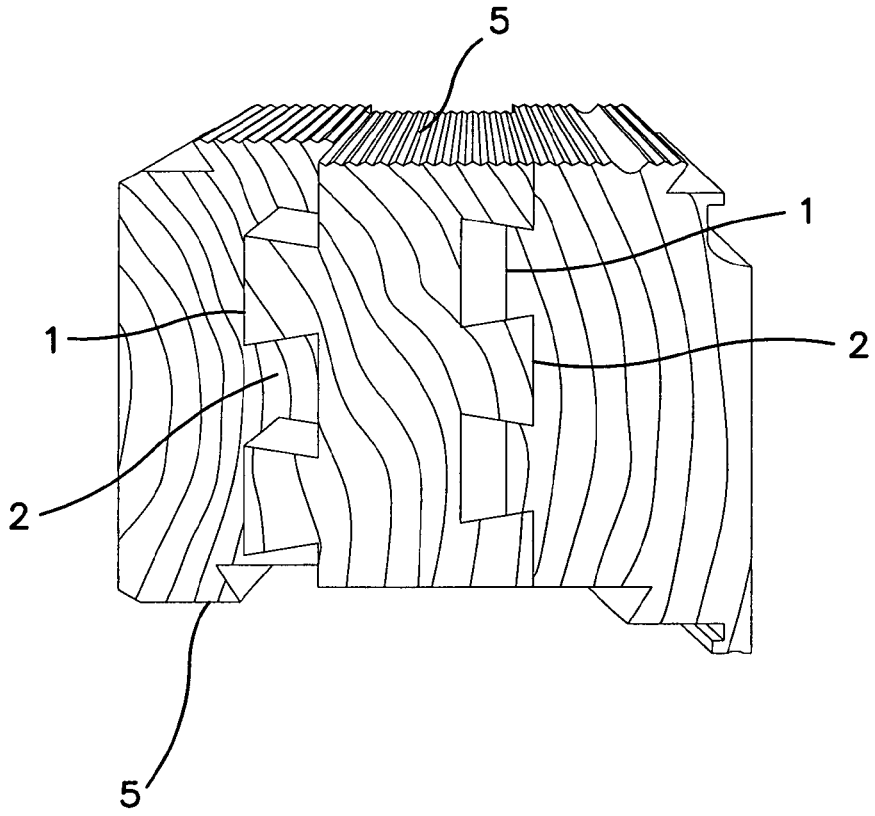

FIG. 8 shows the details of a dove-tailed assembling, one of the girders being only partly inserted in the other girder. In this manner the trapezoidal protuberances (2) (2') (2") and (2'") are shown, partially inserted in the notches (1), (1'), and (1").

What is claimed:

1. A method of assembling massive parts, useful for building wooden chalets or buildings, comprising:

joining together timbers along a longitudinal side of each timber by sliding each two by two, three by three or four by four timber in any order to form a dovetailed assembly, and obtaining massive laminated timber blocks with the dovetailed assembly, which can be assembled to form panels, forming a female wooden element out of a first wooden block to define a series of female trapezoidal notches arranged all along one longitudinal side of the wooden block, forming a male wooden element out of the first wooden block to define a series of male trapezoidal protuberances located on a part or the whole length of one longitudinal side of the male wooden element, the male wooden element of the first wooden block interlocking with a female wooden element of a second wooden block to form dovetailed assemblies, and the female wooden element of the first wooden block interlocking with a male wooden element of a third wooden block to form dovetailed assemblies, and vertically setting stiffeners in the panels through notches, arranged within the timbers.

2. The method of assembling massive parts according to claim 1, comprising:

gluing the timbers to each other with a monocomponent polyurethane glue.

3. The method of assembling massive parts according to claim 1, further comprising:

forming the wooden element on the other longitudinal side, the symmetrical trapezoidal male protuberances that insert into a girder with the female trapezoidal shaped notches, so that a central wooden element is assembled on a whole longitudinal length of another wooden element.

4. The method of assembling massive parts according to claim 1, wherein the symmetrical trapezoidal male protuberances of the male wooden element are fluted on a top part of the male wooden element.

5. The method of assembling massive parts according to claim 1, wherein the panels formed through assembling the laminated timber blocks are held in place by joining poles at each ends of the panels.

6. The method of assembling massive parts according to claim 1, further comprising:

mounting each panel on a double stringpiece fitted by a binding means.

7. The method of assembling massive parts according to claim 1, wherein each timber or girder has a section ranging from 40 to 55 mm and a height of about 200 mm.

8. The method of assembling massive parts according to claim 1, further comprising:

forming a block with a double dove-tail which defines a hollow space in a middle of the block; and inserting cables or pipes in the hollow space.

9. The method of assembling massive parts according to claim 8, further comprising:

stuffing the hollow space with an insulating material to insulate the panels or to tighten a seal between the panels.

10. The method of assembling massive parts according to claim 1, further comprising:

assembling several timbers using a system of dove-tails, each timber having an external or upper face showing flat segments.

11. A wooden chalet manufactured by the method of assembling massive parts of claim 1.

12. A temporary or permanent building manufactured by the method of assembling massive parts of claim 1.

13. A building selected from a group consisting of a shed, a garden shelter, a bungalow, a wooden cottage or a low wall, the building being manufactured by the method of assembling massive parts of claim 1.

14. A building game using cube-shaped blocks that are dove-tailed together using the method of claim 1.

15. An assembly panel constructed of timbers or girders assembled by the method of assembling massive parts according to claim 1.

16. A method of assembling massive parts, useful for building wooden chalets or buildings, comprising:

joining together timbers along a longitudinal side of each timber by sliding each two by two, three by three or four by four timber in any order to form a dovetailed assembly, and obtaining massive laminated timber blocks with the dovetailed assembly, which can be assembled to form panels, forming a male wooden element out of a first wooden block to define a series of female T-shaped notches arranged all along one longitudinal side of the wooden block, forming a female wooden element out of the first wooden block to define a series of male T-shaped protuberances located on a part or the whole length of one longitudinal side of the male wooden element, the male wooden element of the first wooden block interlocking with a female wooden element of a second wooden block to form dovetailed assemblies, the female wooden element of the first wooden block interlocking with a male wooden element of a third wooden block to form dovetailed assemblies, and vertically setting stiffeners in the panels through notches, arranged within the timbers.

17. A method of assembling massive parts, useful for building wooden chalets or buildings, comprising:

joining together timbers along a longitudinal side of each timber by sliding each two by two, three by three or four by four timber in any order to form a dovetailed assembly, and obtaining massive laminated timber blocks with the dovetailed assembly, which can be assembled to form panels, forming a female wooden element out of a first wooden block to define a series of female polygon shaped notches arranged all along one longitudinal side of the wooden block, forming a male wooden element out of the first wooden block to define a series of male polygon shaped protuberances located on a part or the whole length of one longitudinal side of the male wooden element, the male wooden element of the first wooden block interlocking with a female wooden element of a second wooden block to form dovetailed assemblies, the female wooden element of the first wooden block interlocking with a male wooden element of a third wooden block to form dovetailed assemblies, and vertically setting stiffeners in the panels through notches, arranged within the timbers.

18. A method of assembling massive parts, useful for building wooden chalets or buildings, comprising:

joining together timbers along a longitudinal side of each timber by sliding each two by two, three by three or four by four timber in any order to form a dovetailed assembly, and obtaining massive laminated timber blocks with the dovetailed assembly, which can be assembled to form panels, forming a female wooden element out of a first wooden block to define a series of female bean shaped notches arranged all along one longitudinal side of the wooden block, forming a male wooden element out of the first wooden block to define a series of male bean shaped protuberances located on a part or the whole length of one longitudinal side of the male wooden element, the male wooden element of the first wooden block interlocking with a female wooden element of a second wooden block to form dovetailed assemblies the female wooden element of the first wooden block interlocking with a male wooden element of a third wooden block to form dovetailed assemblies, and vertically setting stiffeners in the panels through notches, arranged within the timbers, wherein the bean shaped notches and protuberances each have two curved portions joined by a flat portion.

* * * * *